US009624795B2

(12) United States Patent
Sugiura et al.

(10) Patent No.: US 9,624,795 B2
(45) Date of Patent: Apr. 18, 2017

(54) VARIABLE VALVE MECHANISM OF INTERNAL COMBUSTION ENGINE

(71) Applicant: OTICS CORPORATION, Nishio-shi (JP)

(72) Inventors: Akira Sugiura, Nishio (JP); Takayuki Maezako, Nishio (JP)

(73) Assignee: OTICS CORPORATION, Nishio-Shi, Aichi (JP)

( * ) Notice: Subject to any disclaimer, the term of this patent is extended or adjusted under 35 U.S.C. 154(b) by 0 days.

(21) Appl. No.: 14/808,910

(22) Filed: Jul. 24, 2015

(65) Prior Publication Data

US 2016/0084119 A1 Mar. 24, 2016

(30) Foreign Application Priority Data

Sep. 22, 2014 (JP) ..... 2014-192810

(51) Int. Cl.

| | |
|---|---|
| ***F01L 1/34*** | (2006.01) |
| ***F01L 1/08*** | (2006.01) |
| ***F01L 1/18*** | (2006.01) |
| ***F01L 13/00*** | (2006.01) |
| ***F01L 13/08*** | (2006.01) |
| ***F01L 1/04*** | (2006.01) |

(52) U.S. Cl.

CPC *F01L 1/34* (2013.01); *F01L 1/04* (2013.01); *F01L 1/08* (2013.01); *F01L 1/18* (2013.01); *F01L 13/0036* (2013.01); *F01L 13/08* (2013.01); *F01L 2001/186* (2013.01)

(58) Field of Classification Search

CPC ..... F01L 1/34; F01L 1/04; F01L 1/18; F01L 13/0036; F01L 13/08; F01L 2001/186

USPC ..... 123/90.16

See application file for complete search history.

(56) References Cited

U.S. PATENT DOCUMENTS 4,611,558 A * 9/1986 Yoshizaki ..... F01L 13/0005 123/198 F 6,314,928 B1 11/2001 Baraszu et al.

(Continued)

FOREIGN PATENT DOCUMENTS

DE 102 20 904 A1 11/2003

JP 05-89816 U 12/1993

(Continued)

OTHER PUBLICATIONS

Extended European Search Report dated Feb. 5, 2016.

*Primary Examiner* — Zelalem Eshete

(74) *Attorney, Agent, or Firm* — McGinn IP Law Group, PLLC.

(57) ABSTRACT

The present invention provides a variable valve mechanism of an internal combustion engine, which includes a rocker arm that is driven by a cam so as to swing to drive a valve, a switching pin that is attached to the rocker arm so as to be shifted between a first position and a second position, a shift device that shifts the switching pin from the first position to the second position, and a return spring that returns the switching pin. In the variable valve mechanism, a drive state of the valve is switched by shifting the switching pin, the rocker arm is formed to have such a dimension that one end of the switching pin is exposed while projecting outward from the rocker arm, and the return spring is externally fitted to the one end of the switching pin so as to be exposed outside the rocker arm.

14 Claims, 8 Drawing Sheets

(56) References Cited

U.S. PATENT DOCUMENTS

| | | | | |
|---|---|---|---|---|
| 6,499,451 | B1 | 12/2002 | Hendriksma et al. | |
| 2004/0003791 | A1 * | 1/2004 | Ghelfi ..... | F01L 13/08 123/182.1 |
| 2010/0236507 | A1 | 9/2010 | Kang et al. | |

FOREIGN PATENT DOCUMENTS

| | | | | |
|---|---|---|---|---|
| JP | 2008-208746 | A | 9/2008 | |
| JP | EP 2662540 | A1 * | 11/2013 | ..... F01L 1/34 |
| WO | WO 01/46578 | A1 | 6/2001 | |
| WO | WO 2013/156610 | A1 | 10/2013 | |

* cited by examiner

VARIABLE VALVE MECHANISM OF INTERNAL COMBUSTION ENGINE

TECHNICAL FIELD

The present invention relates to a variable valve mechanism that drives a valve of an internal combustion engine and that switches the drive state of the valve in accordance with an operation status of the internal combustion engine.

BACKGROUND ART

Variable valve mechanisms are described in Patent Documents 1, 2. The variable valve mechanisms each include a rocker arm, a switching pin attached to the rocker arm, a shift device that shifts the switching pin from a first position to a second position, and a return spring that returns the switching pin from the second position to the first position. The drive state of the valve is switched by shifting the switching pin.

CITATION LIST

Patent Document

[Patent Document 1] German Patent Application Publication Specification No. 10220904

[Patent Document 2] Japanese Patent Application Publication No. 2008-208746

[Patent Document 3] Japanese Utility Model Application Publication No. 5-89816

SUMMARY OF INVENTION

Technical Problem

In both variable valve mechanisms of Patent Documents 1 and 2, the rocker arm is formed to have such a dimension that the switching pin and the return spring can be accommodated therein, and thus the rocker arm tends to become large and heavy. The rocker arm thus may become unstable at the time of swinging, or the inertia mass at the time of swinging may become large, leading to degradation in fuel efficiency.

According to the variable valve mechanisms of Patent Documents 1 and 2, the lift amount of the valve in a nose section where a nose of a cam acts can be changed, but the lift amount of the valve in a base circle section where a base circle of the cam acts cannot be changed from zero. The following problems thus cannot be solved.

In other words, in a cylinder that stopped in the middle of a compression stroke, in the middle of an expansion stroke, at its top dead center, or at its bottom dead center, the valves on both an intake side and an exhaust side are closed, and thus the cylinder is sealed. Therefore, the compression resistance and the expansion resistance in the cylinder become large in the next startup of the internal combustion engine, which degrades the startup performance. Furthermore, the startup load to be applied with a motor accordingly becomes large, leading to degradation in the fuel efficiency. As described above, the cylinder is sealed in the state where the valve is closed on both the intake side and the exhaust side, that is, when the internal combustion engine is stopped in the base circle section. Thus, the problem cannot be resolved in the variable valve mechanism described above in which the lift amount in the base circle section cannot be changed from zero.

This problem is particularly significant when all the cylinders are simultaneously sealed. Specifically, for example, in the four-cylinder internal combustion engine, all the four cylinders may be sealed when two cylinders are stopped at the bottom dead center and the other two cylinders are stopped at the top dead center. In this case, at the time of the next startup of the internal combustion engine, in the two cylinders that stopped at the bottom dead center, air is not exhausted from the valve and the space in each cylinder decreases so that the compression resistance becomes large. In the other two cylinders that stopped at the top dead center, air is not taken in from the valve and the space in each cylinder increases so that the expansion resistance becomes large. Thus, the compression resistance or the expansion resistance becomes large in all the four cylinders.

Furthermore, such problem is particularly significant in hybrid engines, engines that carry out idle stop, and the like. This is because in such engines, the frequency of starting up the internal combustion engine with the motor is high, and a large amount of current (power) is consumed by the motor.

Thus, a first object is to achieve downsizing and weight reduction of the rocker arm, and a second object is to reduce the startup load by preventing the cylinder from being sealed at the startup of the internal combustion engine.

Solution to Problem

In order to attain the first object (downsizing and weight reduction of the rocker arm), a variable valve mechanism of an internal combustion engine according to the present invention is configured as below. That is, a variable valve mechanism of an internal combustion engine includes: a rocker arm that is driven by a cam so as to swing to drive a valve; a switching pin that is attached to the rocker arm so as to be shifted between a first position and a second position; a shift device that shifts the switching pin from the first position to the second position; and a return spring that returns the switching pin from the second position to the first position. In the variable valve mechanism, a drive state of the valve is switched by shifting the switching pin, the rocker arm is formed to have such a dimension that one end of the switching pin is exposed while projecting outward from the rocker arm, and the return spring is externally fitted to the one end of the switching pin so as to be exposed outside the rocker arm.

A switching structure of switching the drive state of the valve by shifting the switching pin is not particularly limited, but the following aspects a and b will be described by way of example.

[a] Aspect in which an input member that makes contact with the cam is attached to the rocker arm, where the input member is coupled to the rocker arm such that they cannot move relative to each other when the switching pin is shifted from one of the first position and the second position to the other position, and the coupling is released when the switching pin is shifted from the other position to the one position. Such aspect can be adopted in the case of switching between a high lift drive and a low lift drive or in the case of switching between drive and pause.

[b] Aspect in which a push-out member that makes contact with the cam is attached to the rocker arm, where the push-out member is pushed out toward a rotation center side of the cam from the rocker arm when the switching pin is shifted from one of the first position and the second position to the other position, and the push-out member is retracted into the rocker arm when the switching pin is shifted from the other position to the one position. Such aspect can be adopted in the case of switching between a high lift drive and a low lift drive or in the case of switching between normal drive and constantly-opened drive.

A specific aspect of b (push-out member) is not particularly limited, but the following aspects b1 and b2 will be described by way of example.

[b1] Aspect in which at the time of retraction when the push-out member is retracted, the low lift drive state is established, in which the valve is closed in the base circle section where the base circle of the cam acts and the valve is opened with a relatively small lift amount in the nose section where the nose of the cam acts. At the time of push-out when the push-out member is pushed out, the high lift drive state is established, in which the valve is closed in the base circle section, and the valve is opened with a relatively large lift amount in the nose section.

[b2] Aspect in which at the time of retraction when the push-out member is retracted, the normal state is established, in which the valve is closed in the base circle section where the base circle of the cam acts, and the valve is opened in the nose section where the nose of the cam acts. At the time of push-out when the push-out member is pushed out, the constantly-opened state is established, in which the valve is opened in both the base circle section and the nose section.

In the aspect of b2 (switching between the normal state and the constantly-opened state), the timing to switch to the normal state and the constantly-opened state is not particularly limited, but the following aspect is preferable in order to attain the second object (reduction of startup load). In other words, the time of retraction (normal time) includes time other than a startup of the internal combustion engine, and the time of push-out (constantly-opened time) includes the startup of the internal combustion engine.

Furthermore, in the aspect of b2 (switching between the normal state and the constantly-opened state), the cam may include only a single profile. However, the cam preferably includes the following two profiles so that, at the time of push-out (constantly-opened time), the lift amount in the nose section does not become greater than that at the time of retraction (normal time) and the driving resistance does not become large. In other words, the cam includes a normal profile that drives the rocker arm without the push-out member, and a constantly-opened profile that drives the rocker arm through the push-out member. At the time of retraction (normal time), the rocker arm is driven according to the normal profile in both the base circle section and the nose section, and at the time of push-out (constantly-opened time), the rocker arm is driven according to the constantly-opened profile in the base circle section and the rocker arm is driven according to the normal profile in the nose section so that, at the time of push-out (constantly-opened time) as well, the valve is driven with same lift amount as at the time of retraction (normal time) in the nose section.

The direction in which the switching pin projects out is not particularly limited, but the following aspects c and d will be described by way of example.

[c] Aspect in which the switching pin is arranged so as to be shifted in a width direction of the rocker arm, where one end of the switching pin is projected out in the width direction of the rocker arm.

[d] Aspect in which the switching pin is arranged so as to be shifted in a length direction of the rocker arm, where one end of the switching pin is projected out in the length direction of the rocker arm.

Advantageous Effects of Invention

According to the present invention, the rocker arm is formed to have such a dimension that one end of the switching pin is exposed while projecting outward from the rocker arm, and thus the rocker arm becomes small. Furthermore, the return spring is externally fitted to one end of the switching pin so as to be exposed outside the rocker arm, which prevents the size of the rocker arm from increasing due to the return spring. Therefore, the size and the weight of the rocker arm are reduced. Accordingly, the stability at the time of swinging of the rocker arm increases. Moreover, the inertia mass at the time of swinging becomes small, which improves the fuel efficiency.

DESCRIPTION OF EMBODIMENTS

Figure 1:
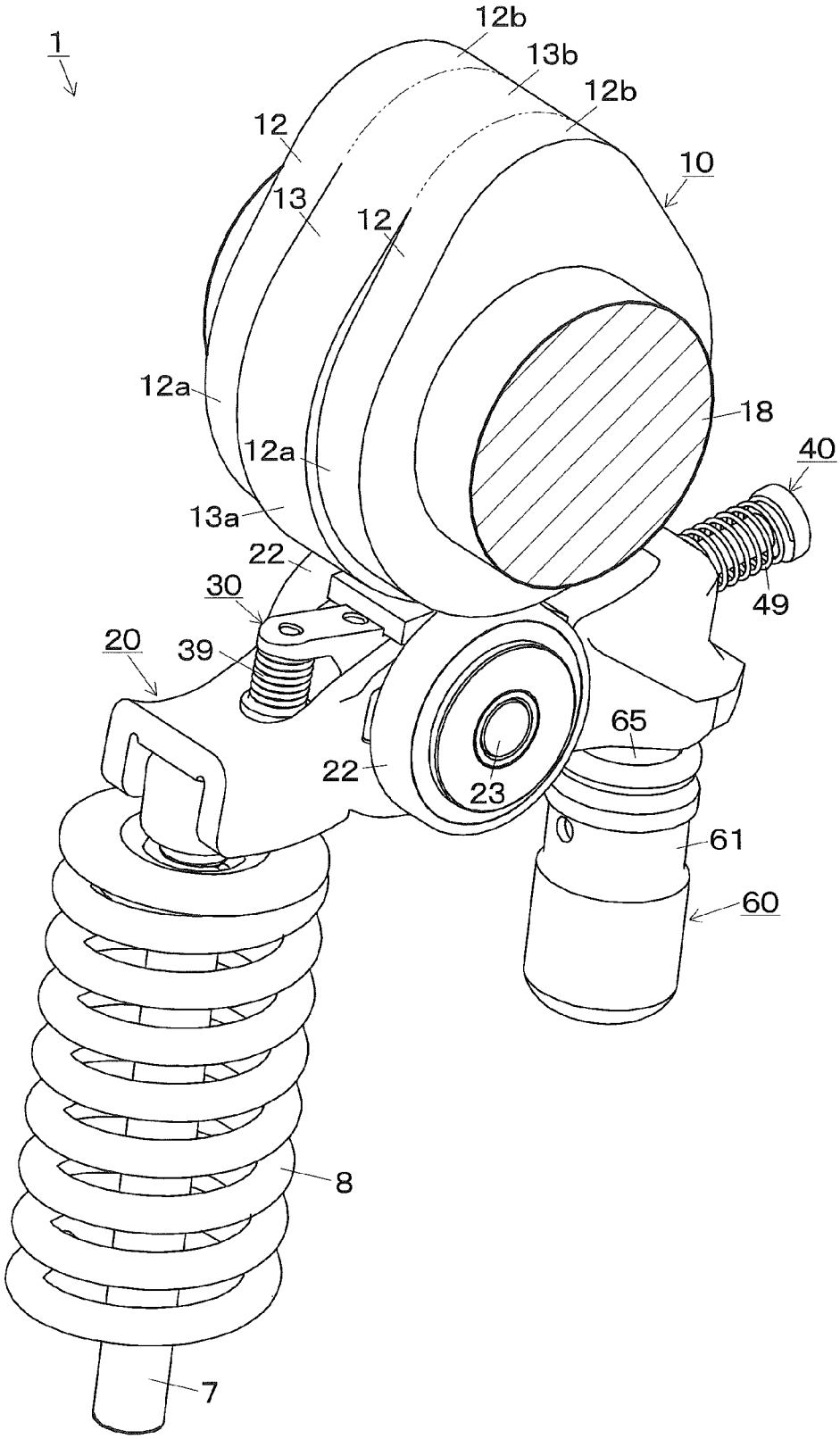
FIG. 1 is a perspective view showing a variable valve mechanism according to a first embodiment.
Figure 2:
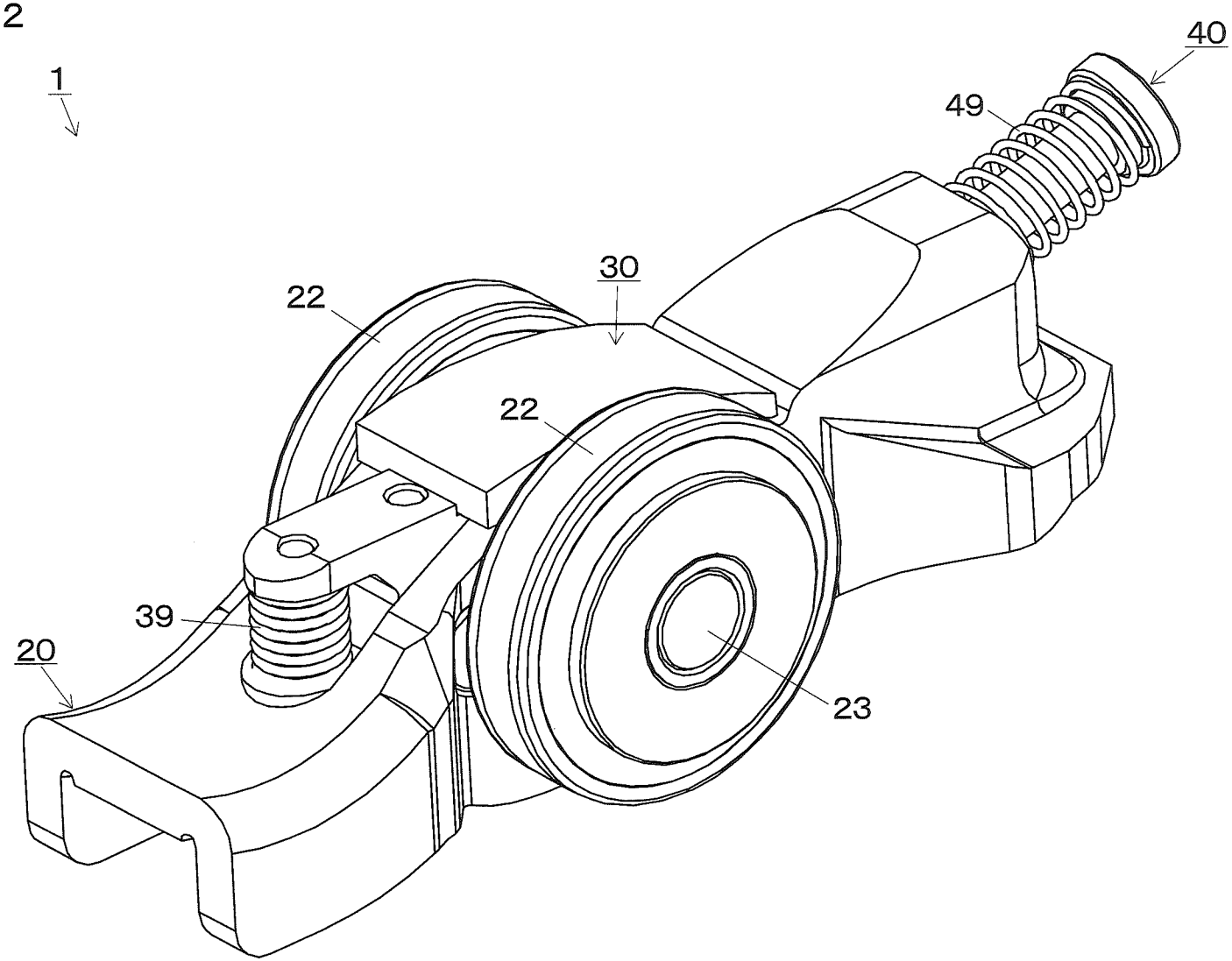
FIG. 2 is a perspective view showing a rocker arm of the variable valve mechanism according to the first embodiment.

Variable valve mechanisms 1, 2 shown in FIGS. 1 to 7 each include a rocker arm 20 that is driven by a cam 10 so as to swing to drive a valve 7, a switching pin 40 attached to the rocker arm 20 so as to be shifted between a first position and a second position, a shift device 50 that shifts the switching pin 40 from the first position (back side) to the second position (front side), and a return spring 49 that returns the switching pin 40 from the second position (front side) to the first position (back side). The drive state of the valve 7 can be switched by shifting the switching pin 40.

Figure 3A:
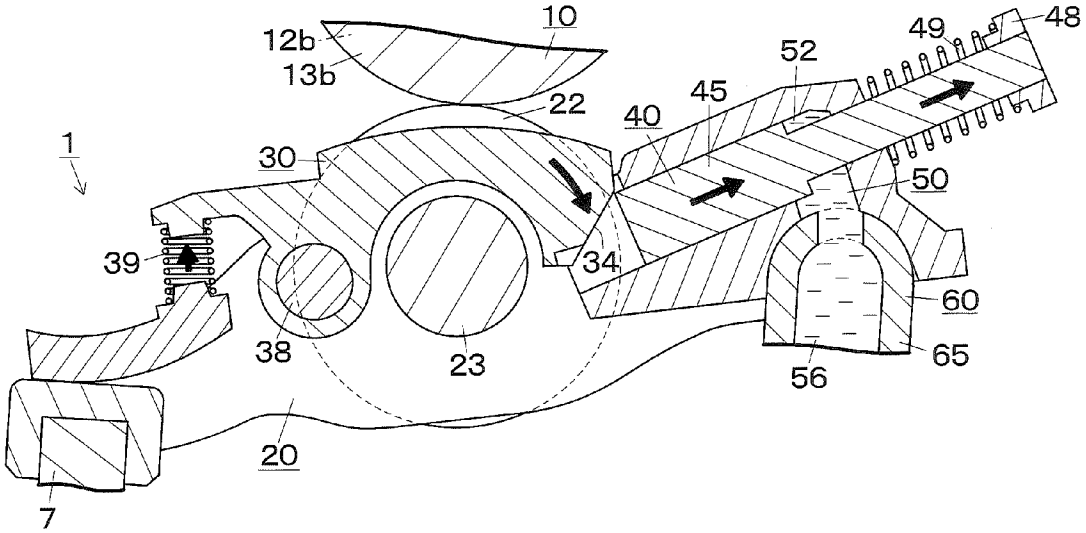
FIG. 3A is a side-sectional view showing the variable valve mechanism according to the first embodiment at a time of retraction when a push-out member is retracted.
Figure 3B:
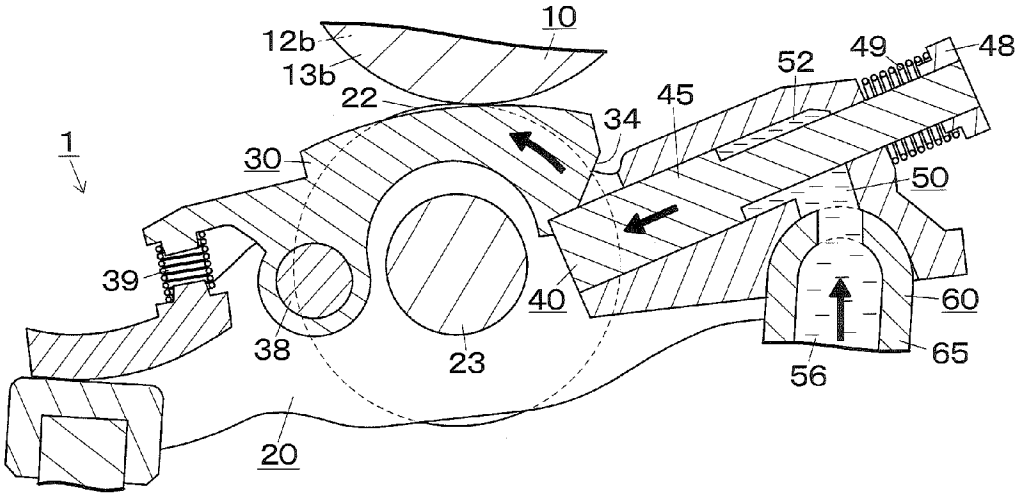
FIG. 3B is a side-sectional view showing the variable valve mechanism according to the first embodiment at a time of push-out when the push-out member is pushed out.

Specifically, a push-out member 30 that makes contact with the cam 10 is attached to the rocker arm 20. When the switching pin 40 is shifted from the first position (back side) to the second position (front side), the push-out member 30 is pushed out toward the rotation center side of the cam 10 from the rocker arm 20, as shown in FIG. 3B. When the switching pin 40 is returned from the second position (front side) to the first position (back side), the push-out member 30 retracts into the rocker arm 20, as shown in FIG. 3A.

The rocker arm 20 is formed to have such a dimension that one end of the switching pin 40 is exposed while projecting outward from the rocker arm 20. The return spring 49 is externally fitted to the one end of the switching pin 40 so as to be exposed outside the rocker arm 20.

[First Embodiment]

The variable valve mechanism 1 of the first embodiment shown in FIGS. 1 to 6 is a mechanism that periodically opens/closes the valve 7 by periodically pushing the exhaust valve 7 in such a direction that the exhaust valve 7 opens. A valve spring 8, which biases the valve 7 in such a direction that the valve 7 is closed, is externally fitted to the valve 7. The variable valve mechanism 1 is configured to include the cam 10, the rocker arm 20, the push-out member 30, the switching pin 40, the shift device 50, and a lash adjuster 60.

The cam 10 is provided on a cam shaft 18 so as to protrude from the camshaft 18. The camshaft 18 makes one rotation each time the internal combustion engine makes two rotations. The cam 10 includes normal profiles 12, 12 that drive the rocker arm 20 without the push-out member 30, and a constantly-opened profile 13 that drives the rocker arm 20 through the push-out member 30. Specifically, the cam 10 includes right and left normal profiles 12, 12 arranged spaced apart from each other on both sides in the width direction of the cam 10, and the constantly-opened profile 13 arranged between the normal profiles 12, 12. Each normal profile 12 is configured to include a normal base circle 12*a* having a cross-sectional shape of a true circle, and a normal nose 12*b* that projects out from the normal base circle 12*a*. The constantly-opened profile 13 is configured to include a constantly-opened base circle 13*a* of a true circle having a larger diameter than the normal base circle 12*a*, and a constantly-opened nose 13*b* having the same shape as the normal nose 12*b* excluding at both ends. Thus, the length of projection of the constantly-opened nose 13*b* from the constantly-opened base circle 13 is smaller than the length of projection of the normal nose 12*b* from the normal base circle 12*a*. The right and left normal profiles 12, 12 make contact with right and left rollers 22, 22 of the rocker arm 20. The constantly-opened profile 13 makes sliding contact with the push-out member 30.

The back end portion of the rocker arm 20 is swingably supported by the lash adjuster 60. The front end portion of the rocker arm 20 is in contact with the valve 7. The right and left rollers 22, 22 that make contact with the normal profiles 12, 12 of the cam 10 are rotatably attached, by way of one roller shaft 23, to an intermediate portion of the rocker arm 20 in its length direction.

The push-out member 30 is arranged between the right and left rollers 22, 22. The push-out member 30 is pivotally attached, at its intermediate portion in the length direction, to the rocker arm 20 by way of a supporting shaft 38. A back part of the push-out member 30 is pushed out from the rocker arm 20 when the push-out member 30 pivots from one side toward the other side in the pivoting direction, and the back part retracts into the rocker arm 20 when the push-out member 30 pivots from the other side to one side. The front end portion of the switching pin 40 is in contact with the back end portion of the push-out member 30. The back end portion of the push-out member 30 has an inclined surface 34 that converts a force received from the switching pin 40 to a force in the push-out direction (toward the other side in the pivoting direction) when the switching pin 40 is shifted from the first position (back side) to the second position (front side). A retracting spring 39 that biases the push-out member 30 in the retracting direction (toward the one side in the pivoting direction) is attached between the lower surface of the front end portion of the push-out member 30 and the upper surface of the rocker arm 20.

The switching pin 40 is a pin extending in the length direction of the rocker arm 20, a back part of which projects backward from the back end face of the rocker arm 20. A coil-shaped return spring 49 is externally fitted to the back part of the switching pin 40. The return spring 49 biases the switching pin 40 toward the first position side (back side). Specifically, the front end of the return spring 49 is in contact with the back end face of the rocker arm 20, and the back end of the return spring 49 is in contact with the front surface of a ring member 48 fitted to the back end portion of the switching pin 40. The front part of the switching pin 40 has a large diameter portion 45 having a diameter larger than that of the back part.

The shift device 50 is configured to include a hydraulic chamber 52 arranged on the back side of the large diameter portion 45 of the switching pin 40 in the rocker arm 20, and an oil passage 56 that supplies the oil pressure to the hydraulic chamber 52. The oil passage 56 passes the interior of the lash adjuster 60. By increasing the oil pressure of the hydraulic chamber 52 (turning on the shift device 50), the large diameter portion 45 is pushed toward the second position side (front side) with the oil pressure so that the switching pin 40 moves from the first position (back side) to the second position (front side). The inclined surface 34 of the push-out member 30 is thereby pushed by the switching pin 40, and the push-out member 30 pivots toward the other side in the pivoting direction so that the back part thereof is pushed out from the rocker arm 20. The front end portion of the switching pin 40 slides below the inclined surface 34 at the back end portion of the push-out member 30. When the oil pressure of the hydraulic chamber 52 is decreased (the shift device 50 is turned off), the switching pin 40 moves from the second position (front side) to the first position (back side) due to the biasing force of the return spring 49. Thus, the push-out member 30 pivots toward the one side in the pivoting direction due to the biasing force of the retracting spring 39 so that the back part of the push-out member 30 retracts into the rocker arm 20. Both right and left portions of the back part of the push-out member 30 are pushed against the upper part of the rocker arm 20.

The lash adjuster 60 is a hydraulic lash adjuster for automatically filling a clearance formed between the cam 10 and the roller 22 without excess or deficiency. The lash adjuster 60 is configured to include a bottomed tubular body 61 that opens upward, and a plunger 65, the lower portion of which is inserted into the body 61. The upper end of the plunger 65 swingably supports the back end portion of the rocker arm 20.

[Function]

At the time of retraction when the push-out member 30 is retracted as shown in FIG. 3A, the normal state described below is established. In other words, in the normal state, the valve 7 is closed as shown in FIG. 4A in the base circle section A (section where the base circles 12*a*, 13*a* of the cam 10 act, hereinafter the same), and the valve 7 is opened as shown in FIG. 4B in the nose section B (section where the noses 12*b*, 13*b* of the cam 10 act).

Figure 4B:
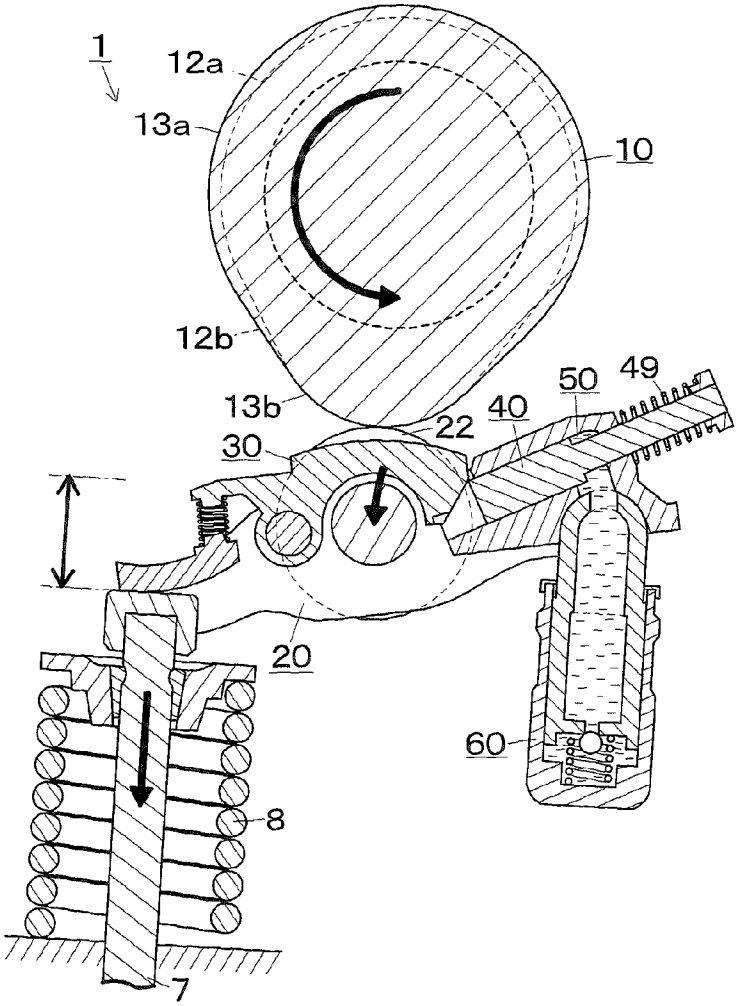
FIG. 4B is a side-sectional view showing the variable valve mechanism according to the first embodiment in a nose section, at the time of retraction (normal time)
Figure 4A:
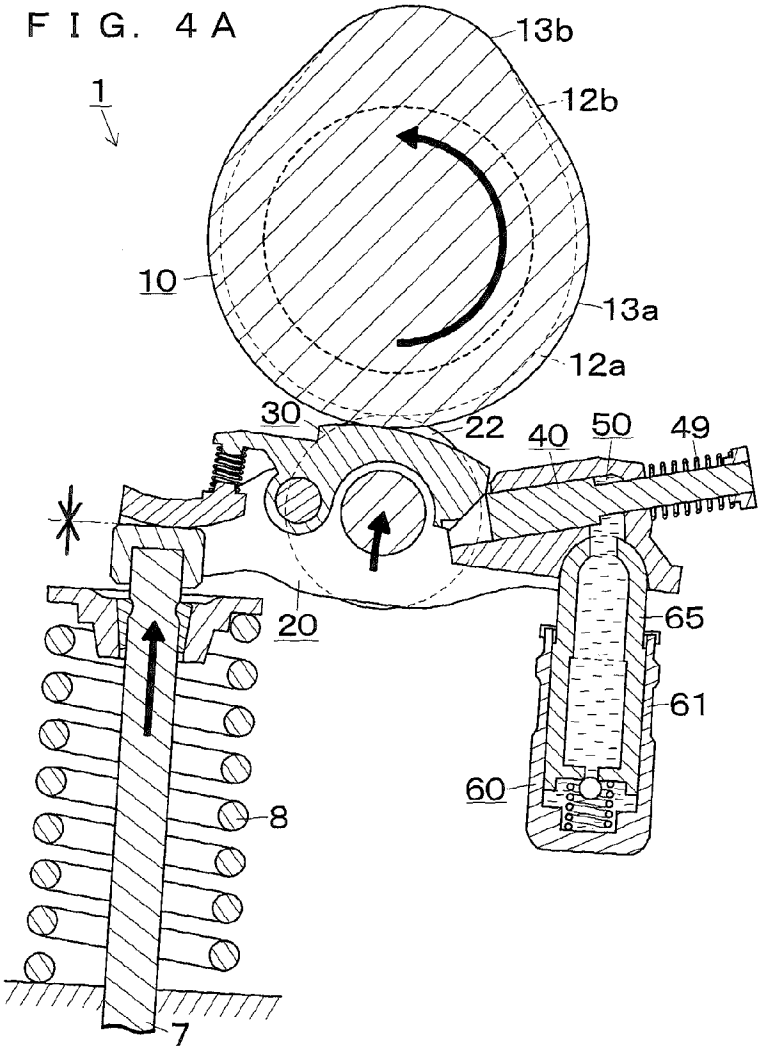
FIG. 4A is a side-sectional view showing the variable valve mechanism according to the first embodiment in a base circle section.

Specifically, at the time of retraction (normal time), the rocker arm 20 is driven according to the normal profiles 12, 12 as shown in FIGS. 4A and 4B in both the base circle section A and the nose section B, as will be described below. In other words, in the base circle section A at the time of retraction, the rollers 22, 22 make contact with the normal base circles 12*a*, 12*a*, and a minute gap (relatively small gap) is formed between the constantly-opened base circle 13*a* and the push-out member 30, as shown in FIG. 4A. In the nose section B at the time of retraction, the normal noses 12*b*, 12*b* push the rollers 22, 22, and a gap (relatively large gap) is formed between the constantly-opened nose 13*b* and the push-out member 30, as shown in FIG. 4B.

At the time of push-out when the push-out member 30 is pushed out as shown in FIG. 3B, the constantly-opened state described below is established. In other words, in the constantly-opened state, the valve 7 is opened, as shown in FIGS. 5A and 5B, in both the base circle section A and the nose section B.

Figure 5B:
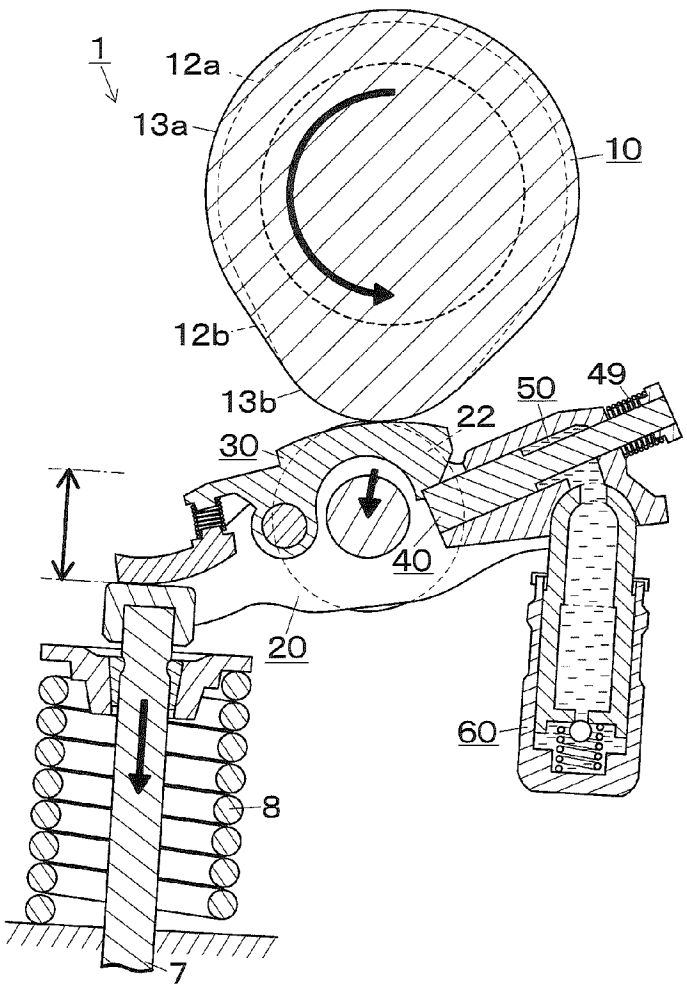
FIG. 5B is a side-sectional view showing the variable valve mechanism according to the first embodiment in the nose section, at the time of push-out (constantly-opened time)
Figure 5A:
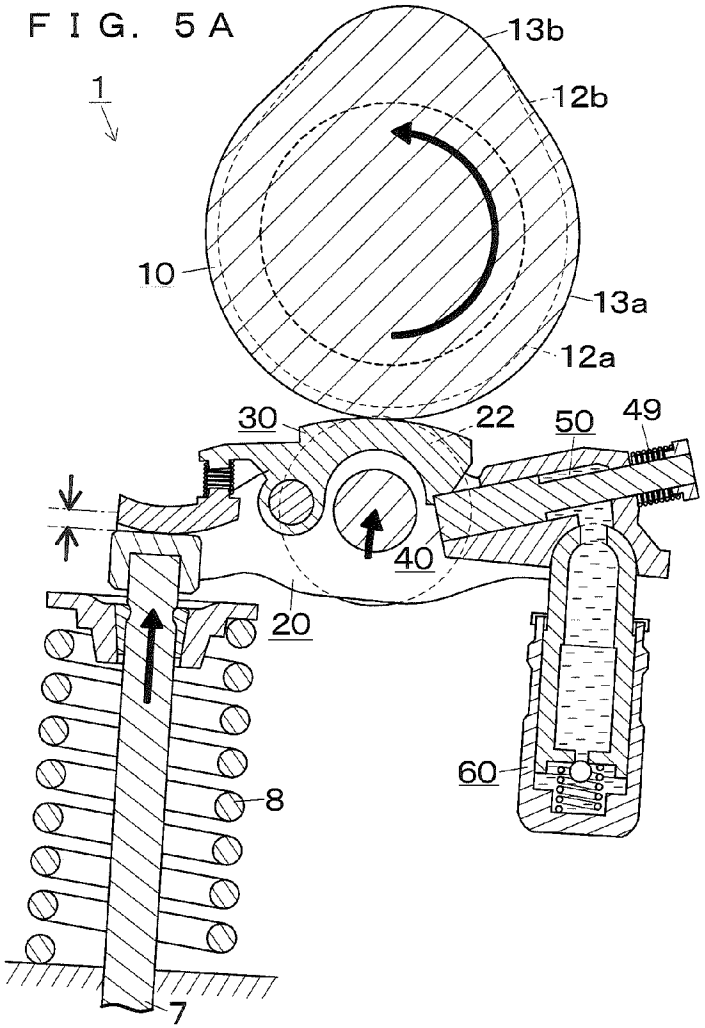
FIG. 5A is a side-sectional view showing the variable valve mechanism according to the first embodiment in a base circle section.

Specifically, at the time of push-out (constantly-opened time), the rocker arm 20 is driven according to the constantly-opened profile 13 (constantly-opened base circle 13*a*), as shown in FIG. 5A, in the base circle section A, and the rocker arm 20 is driven according to the normal profiles 12, 12 (normal noses 12*b*, 12*b*), as shown in FIG. 5B, in the nose section B. In other words, in the base circle section A at the time of push-out, the push-out member 30 makes contact with the constantly-opened base circle 13*a*, and a gap (relatively large gap) is formed between the normal base circles 12*a*, 12*a* and the rollers 22, 22, as shown in FIG. 5A. In the nose section B at the time of push-out, the normal noses 12*b*, 12*b* push the rollers 22, 22, and a minute gap (relatively small gap) is formed between the constantly opened nose 13*b* and the push-out member 30, as shown in FIG. 5B.

Figure 6:
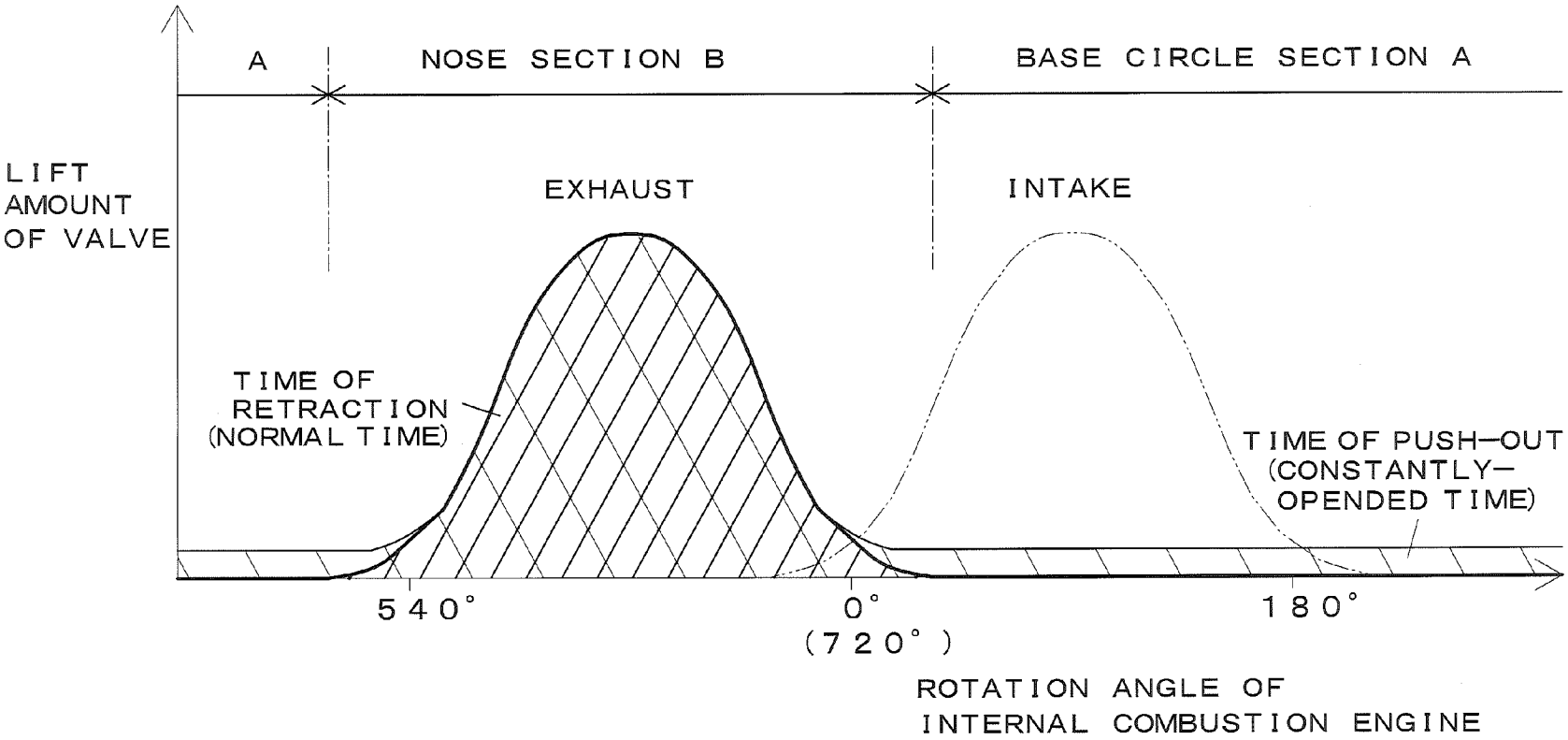
FIG. 6 is a graph showing a relationship between a rotation angle of an internal combustion engine and a lift amount of a valve in the variable valve mechanism according to the first embodiment.

Thus, as shown in FIG. 6, at the time of retraction (normal time) and at the time of push-out (constantly-opened time), the valve 7 is driven with the same lift amount according to the normal profiles 12, 12 (normal noses 12*b*, 12*b*) in the nose section B. The time of retraction (normal time) includes a time other than the startup of the internal combustion engine, and the time of push-out (constantly-opened time) includes the startup of the internal combustion engine.

[Effect]

The first embodiment has the following effects A to E.

[A] The rocker arm. 20 is formed to have such a dimension that the switching pin 40 is exposed while projecting outward from the rocker arm 20, and thus the rocker arm 20 becomes small. Furthermore, the return spring 49 is externally fitted to the switching pin 40 so as to be exposed outside the rocker arm 20, and therefore, the size of the rocker arm 20 is prevented from increasing due to the return spring 49. Thus, the size and the weight of the rocker arm 20 are reduced. The stability at the time of swinging of the rocker arm 20 thus increases. Furthermore, the inertia mass at the time of swinging becomes small, which improves the fuel efficiency.

[B] Since the constantly-opened state is established at the startup of the internal combustion engine, the cylinder is prevented from being sealed at the startup. Thus, the startup performance is improved, and the startup load to be applied with the motor at the startup is reduced, which improves the fuel efficiency.

Figure 8A:
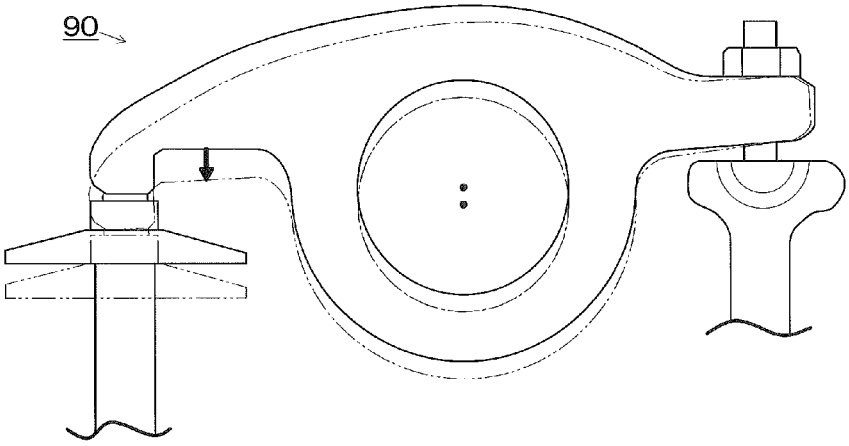
FIG. 8A RELATED ART
FIG. 8A is a side view showing a valve mechanism.
Figure 8B:
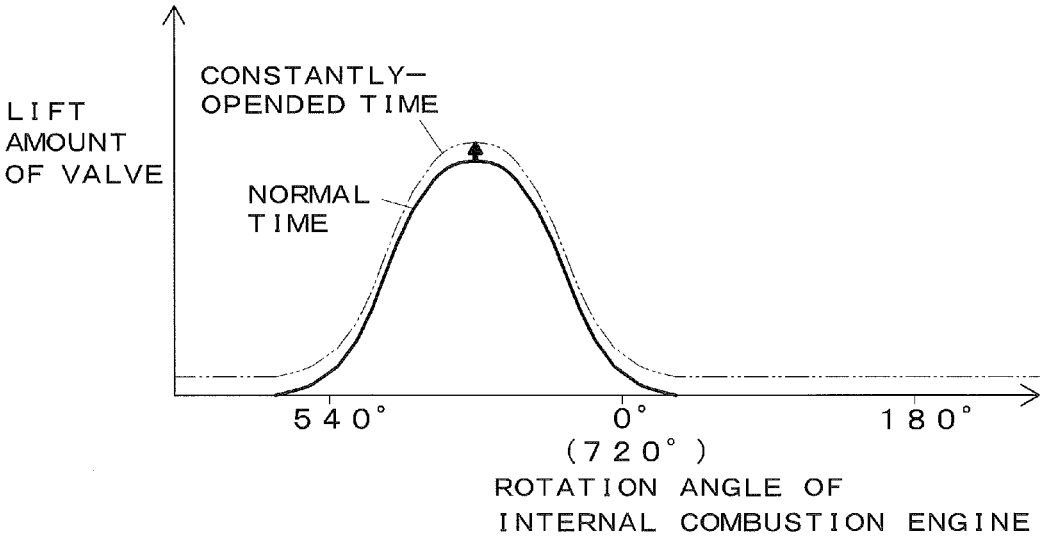
FIG. 8B RELATED ART
FIG. 8B is a graph showing a relationship between a rotation angle of an internal combustion engine and a lift amount of a valve according to Patent Document 3.

[C] At the time of push-out (constantly-opened time) as well, the valve 7 is driven with the same lift amount as at the time of retraction (normal time) in the nose section B, as shown in FIG. 6, and thus the lift amount in the nose section B does not increase at the constantly-opened time, unlike the case of the valve mechanism 90 of related art document 3 shown in FIGS. 8A and 8B. Therefore, concerns are eliminated about the driving resistance increasing with an increase in the lift amount in the nose section B, which may inhibit the reduction of the startup load.

[D] In the nose section B at the time of retraction (normal time), a gap is formed between the constantly-opened profile 13 (constantly-opened nose 13*b*) and the push-out member 30, as shown in FIG. 3A, and thus the push-out member 30 can be easily pushed out in this case, as shown in FIG. 3B.

[E] The first embodiment can be implemented by simply replacing the rocker arm of the conventional valve mechanism for driving the valve through the rocker arm with the rocker arm 20 (rocker arm 20 including the push-out member 30, the switching pin 40, the return spring 49, and the shift device 50), and thus, the conventional parts can be used as they are for the other portions.

[Second Embodiment]

Figure 7:
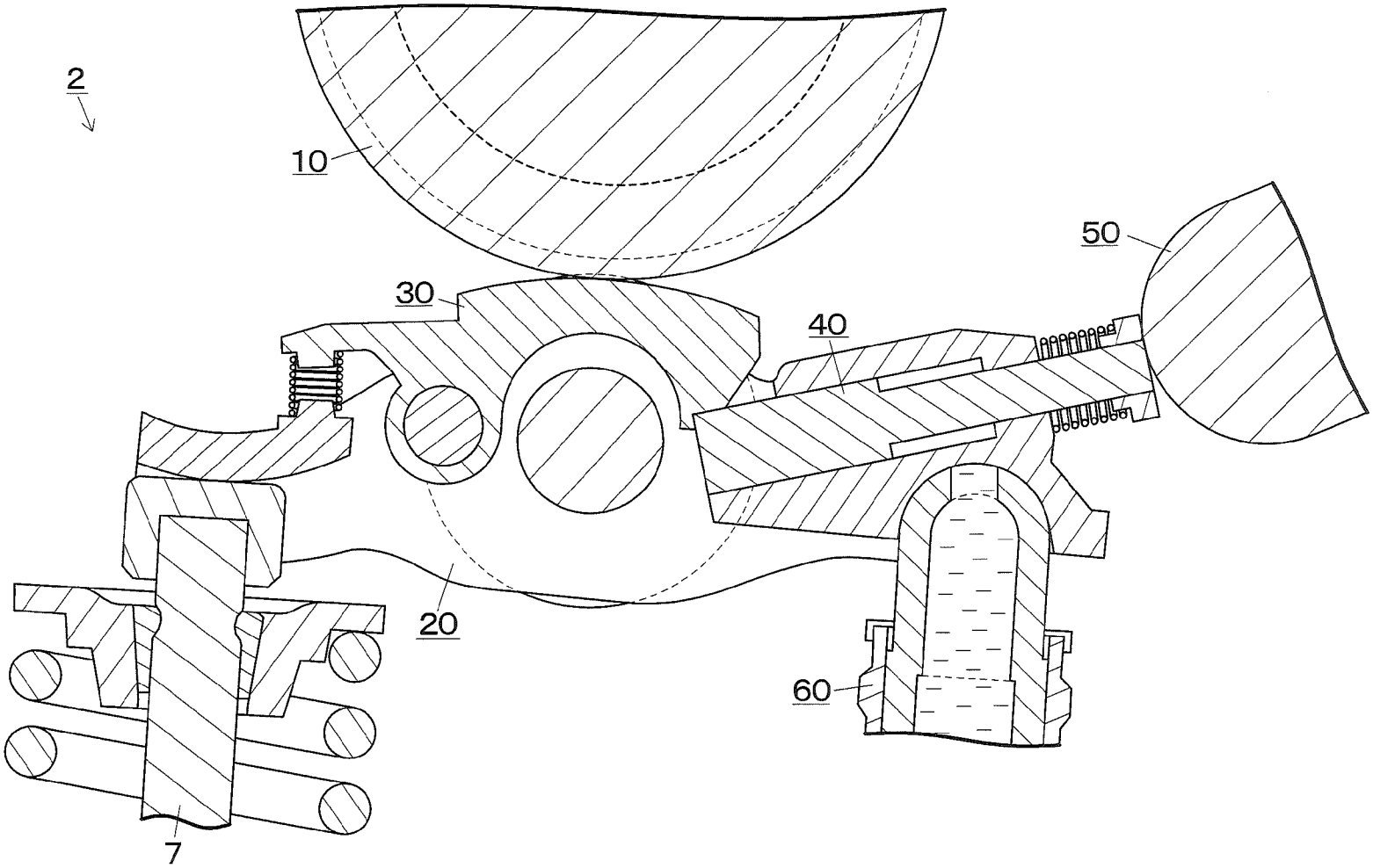
FIG. 7 is a side-sectional view showing a variable valve mechanism according to a second embodiment.

A variable valve mechanism 2 of a second embodiment shown in FIG. 7 is similar to the variable valve mechanism 1 of the first embodiment except that the shift device 50 is arranged behind and outside the rocker arm 20, and the back end portion of the switching pin 40 is pushed from behind and outside.

The second embodiment has the following effect F in addition to the effects A to E of the first embodiment.

[F] The switching pin 40 is exposed while projecting backward from the back end of the rocker arm 20, and thus the back end portion of the switching pin 40 can be easily pushed with the shift device 50 arranged behind and outside the rocker arm 20. Thus, by arranging the shift device 50 outside the rocker arm 20, the size and the weight of the rocker arm 20 can be further reduced. Accordingly, the stability at the time of swinging of the rocker arm 20 further increases. Moreover, the inertia mass at the time of swinging is further reduced, which further improves the fuel efficiency.

The present invention is not limited to the embodiments described above, and may be embodied by being appropriately modified without departing from the scope of the invention. For example, the present invention may be modified as in the following modifications.

[First Modification]

The shift device 50 may be an electromagnetic shift device (electromagnetic solenoid) that shifts the switching pin 40 with an electromagnetic force.

[Second Modification]

The constantly-opened base circle 13*a* may have the same shape (same diameter) as the normal base circles 12*a*, 12*a*, and the constantly-opened nose 13*b* may be formed shorter than the normal noses 12*b*, 12*b*, so that the length of projection of the constantly-opened nose 13*b* is smaller than the length of projection of the normal nose 12*b*.

[Third Modification]

The variable valve mechanism 1, 2 may be provided for the intake valve.

REFERENCE SIGNS LIST

1 Variable valve mechanism (First embodiment)
2 Variable valve mechanism (Second embodiment)
7 Valve
10 Cam
12 Normal profile
12*a* Normal base circle
12*b* Normal nose
13 Constantly-opened profile
13*a* Constantly-opened base circle
13*b* Constantly-opened nose

20 Rocker arm
30 Push-out member
40 Switching pin
49 Return spring
50 Shift device
A Base circle section
B Nose section

The invention claimed is:

1. A variable valve mechanism of an internal combustion engine, comprising:

a rocker arm that is driven by a cam so as to swing to drive a valve;

a switching pin that is attached to the rocker arm so as to be shifted between a first position and a second position;

a shift device that shifts the switching pin from the first position to the second position; and a return spring that returns the switching pin from the second position to the first position, wherein a drive state of the valve is switched by shifting the switching pin, the rocker arm is formed to have such a dimension that one end of the switching pin is exposed while projecting backward and outward from a back end of the rocker arm, and the return spring is externally fitted to the one end of the switching pin so as to be exposed outside the rocker arm;

a push-out member that makes contact with the cam is attached to the rocker arm, wherein the push-out member is pushed out toward a rotation center side of the cam from the rocker arm when the switching pin is shifted from one of the first position and the second position to the other position, and the push-out member is retracted into the rocker arm when the switching pin is shifted from the other position to the one position, wherein, at a time of retraction when the push-out member is retracted, a normal state is established, in which the valve is closed in a base circle section where a base circle of the cam acts and the valve is opened in a nose section where a nose of the cam acts, wherein, at a time of push-out when the push-out member is pushed out, a constantly-opened state is established, in which the valve is opened in both the base circle section and the nose section;

a retracting spring that biases the push-out member in such a direction that the push-out member retracts, wherein, at the time of retraction, a gap is formed between the base circle and the push-out member, and a gap is formed between the nose and the push-out member.

2. The variable valve mechanism of an internal combustion engine according to claim 1, wherein the time of retraction includes a time other than a startup of the internal combustion engine, and the time of push-out includes the startup of the internal combustion engine.

3. The variable valve mechanism of an internal combustion engine according to claim 1, wherein the cam includes a normal profile that drives the rocker arm without the push-out member, and a constantly-opened profile that drives the rocker arm through the push-out member, and at the time of retraction, the rocker arm is driven according to the normal profile in both the base circle section and the nose section, and at the time of push-out, the rocker arm is driven according to the constantly-opened profile in the base circle section and the rocker arm is driven according to the normal profile in the nose section, so that, at the time of push-out, the valve is driven with the same lift amount as at the time of retraction in the nose section.

4. The variable valve mechanism of an internal combustion engine according to claim 2, wherein the cam includes a normal profile that drives the rocker arm without the push-out member, and a constantly-opened profile that drives the rocker arm through the push-out member, and at the time of retraction, the rocker arm is driven according to the normal profile in both the base circle section and the nose section, and at the time of push-out, the rocker arm is driven according to the constantly-opened profile in the base circle section and the rocker arm is driven according to the normal profile in the nose section, so that, at the time of push-out, the valve is driven with the same lift amount as at the time of retraction in the nose section.

5. The variable valve mechanism of an internal combustion engine according to claim 1, wherein the return spring has a front end that is in contact with a back end face of the rocker arm, and a back end that is in contact with a front surface of a ring member fitted to a back end portion of the switching pin.

6. The variable valve mechanism of an internal combustion engine according to claim 1, wherein the push-out member is pivotally attached, at its intermediate portion in a length direction, to the rocker arm by way of a supporting shaft.

7. The variable valve mechanism of an internal combustion engine according to claim 6, wherein a back end portion of the push-out member has an inclined surface for converting a force received from the switching pin to a force in a push-out direction when the switching pin is shifted from the first position to the second position.

8. The variable valve mechanism of an internal combustion engine according to claim 7, wherein when the switching pin is moved from the first position to the second position, a front end portion of the switching pin slides below the inclined surface at the back end portion of the push-out member.

9. The variable valve mechanism of an internal combustion engine according to claim 6, wherein the retracting spring is attached between a lower surface of the front end portion of the push-out member and an upper surface of the rocker arm.

10. The variable valve mechanism of an internal combustion engine according to claim 7, wherein the retracting spring is attached between a lower surface of the front end portion of the push-out member and an upper surface of the rocker arm.

11. The variable valve mechanism of an internal combustion engine according to claim 1, wherein the shift device is arranged behind and outside the rocker arm.

12. The variable valve mechanism of an internal combustion engine according to claim 1, wherein an intermediate portion in a length direction of the push-out member is pivotally attached to the rocker arm by a supporting shaft.

13. The variable valve mechanism of an internal combustion engine according to claim 1, wherein a constantly-opened base circle has a same diameter as the base circle, and wherein a constantly-opened nose is formed shorter than the nose so that a length of a projection of the constantly-opened nose is less than a length of projection of the nose.

14. The variable valve mechanism of an internal combustion engine according to claim 5, wherein a front part of the switching pin has a large diameter portion having a diameter greater than a diameter of a back part of the switching pin.

* * * * *